US006727856B1

(12) United States Patent
Hill

(10) Patent No.: US 6,727,856 B1
(45) Date of Patent: Apr. 27, 2004

(54) ANTENNA SYSTEM FOR A WIRELESS DEVICE

(75) Inventor: Robert J. Hill, Prunedale, CA (US)

(73) Assignee: Good Technology, Inc., Sunnyvale, CA (US)

( * ) Notice: Subject to any disclaimer, the term of this patent is extended or adjusted under 35 U.S.C. 154(b) by 63 days.

(21) Appl. No.: 10/164,819

(22) Filed: Jun. 6, 2002

(51) Int. Cl.[7] ..... H01Q 1/26
(52) U.S. Cl. ..... 343/701; 343/702
(58) Field of Search ..... 343/701, 702, 343/700 MS

(56) References Cited

U.S. PATENT DOCUMENTS 3,736,591 A * 5/1973 Rennels et al. ..... 343/702
6,195,054 B1 * 2/2001 Washino et al. ..... 343/702
6,437,745 B1 * 8/2002 Vaisanen et al. ..... 343/702
6,580,397 B2 * 6/2003 Lindell ..... 343/702
6,618,014 B2 * 9/2003 Stoiljkovic et al. ..... 343/702
2003/0090422 A1 * 5/2003 Diament ..... 343/700 MS

* cited by examiner

*Primary Examiner*—Tan Ho
(74) *Attorney, Agent, or Firm*—Blakely Sokoloff Taylor & Zafman LLP

(57) ABSTRACT

An enclosure for a wireless device is described which may be used as the device's antenna. In one embodiment, the enclosure is comprised of two charged front and back conducting plates which propagate an electric field used to transmit and receive vertically polarized omnidirectional electromagnetic signals from a first orientation. In addition, the size of the plates are selected to propagate a second electric field which is used to transmit and receive vertically polarized electromagnetic signals in a second orientation, where, in one embodiment, the second orientation is orthogonal to the first orientation.

28 Claims, 15 Drawing Sheets

ANTENNA SYSTEM FOR A WIRELESS DEVICE

BACKGROUND

1. Field of the Invention

This invention relates generally to the field of network data services. More particularly, the invention relates to an improved antenna for receiving signals on a wireless device.

2. Description of the Related Art

Antenna systems used in current cell phones and wireless data processing devices are typically comprised of a single straight wire or conducting loop contained within the devices' casing. FIGS. 1*a* and 1*b* illustrate some of the basic principles associated with antenna theory. The electromagnetic signal received by an antenna 110 is comprised of an electric field vector (E) 120 and a magnetic field vector (H) 130. The magnetic field vector 130 is perpendicular to the electric field vector 120. The wave shown in FIG. 1*a* is said to be "vertically polarized" because the electric field vector is in a vertical orientation. The plane defined by E and H is a plane of energy (measured in, e.g., watts/$m^2$) traveling in the direction of Wave propagation (Z) 150. The transmitter 100 may transmit the wave at various frequencies and using various types of modulation, depending on the particular standards involved (e.g., CDMA, GSM, TDMA, . . . etc).

The antenna 110 configured within the wireless device 105 also transmits and receives an electric field component (E) 121 and a magnetic field component (not shown). For ideal reception, the electric field component 121 of the wireless device's antenna 110 should have the same vertical orientation as the electric field component 120 of the base station signal when the wireless device is in the dominant user position. By contrast, if the electric field 121 of the antenna is perpendicular to the electric field 120 of the base station wave, as illustrated in FIG. 1*b*, the antenna will not effectively receive the base station signal. Because of this cross-polarized condition, the wireless device will not effectively receive vertically polarized signals from the base station when the wireless device is in a horizontal orientation.

FIGS. 2*a* and 2*b* plot signal strength as a function of the wireless device's rotation. The plot shown in FIG. 2*a* is associated with rotation arrow 140 shown in FIG. 1*a* and the plot shown in FIG. 2*b* is associated with rotation arrow 142 shown in FIG. 1*b*. If the wireless device is rotated along its vertical axis as indicated by rotation arrow 140, the vertical component of the antenna's electric field 121 remains in a vertical orientation and signal reception strength is excellent because the electric field vectors of both the base station and the wireless device are aligned. If, however, the device is rotated as indicated by rotation arrow 142 in the horizontal position illustrated in FIG. 1*b*, then the device's ability to capture energy from the incoming vertically polarized signal is greatly degraded because the electric field of the device's antenna has rotated from a vertical to a horizontal polarization condition.

In sum, present wireless devices are incapable of effectively receiving vertically polarized waves when the wireless device is in a horizontal orientation. Thus, when placed horizontally on a tabletop, the signal strength generally becomes very weak. Adding an additional antenna may strengthen the signal but adds significantly to the cost and complexity of the device.

Moreover, because the antenna 110 is contained within the wireless device 105 the casing must be limited to dielectric materials such as rubber or plastic in the region containing the antenna. In addition, the antenna 110 may consume a significant amount of space within the device 105 which could otherwise be used to make the device more compact and less expensive to manufacture.

Accordingly, what is needed is an antenna system which can effectively transmit and receive a vertically polarized signal when the wireless device is in the vertically oriented dominant user position as well as when the wireless device is placed horizontally on a table. What is also needed is an antenna system which does not consume space within the wireless device or limit the type of material with which the wireless device may be constructed.

SUMMARY

An enclosure for a wireless device is described which may be used as the device's antenna. In one embodiment, the enclosure is designed such that the wireless device is capable of receiving vertically polarized signals in two distinct orthogonal orientations. The antenna is comprised of two charged front and back conducting plates which propagate an omnidirectional vertically polarized electric field used to transmit and receive electromagnetic signals from a first orientation. In addition, in one embodiment, the size of the plates are selected to propagate a second vertically polarized electric field which is used to transmit and receive electromagnetic signals in a second orthogonal orientation.

BRIEF DESCRIPTION OF THE DRAWINGS

A better understanding of the present invention can be obtained from the following detailed description in conjunction with the following drawings, in which.

DETAILED DESCRIPTION

In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form to avoid obscuring the underlying principles of the present invention.

In one embodiment of the invention, the case of the wireless device (or portion thereof) is used as the antenna system, thereby freeing space within the wireless device and allowing the case to be manufactured from metal or other conductive materials.

Figure 1A:
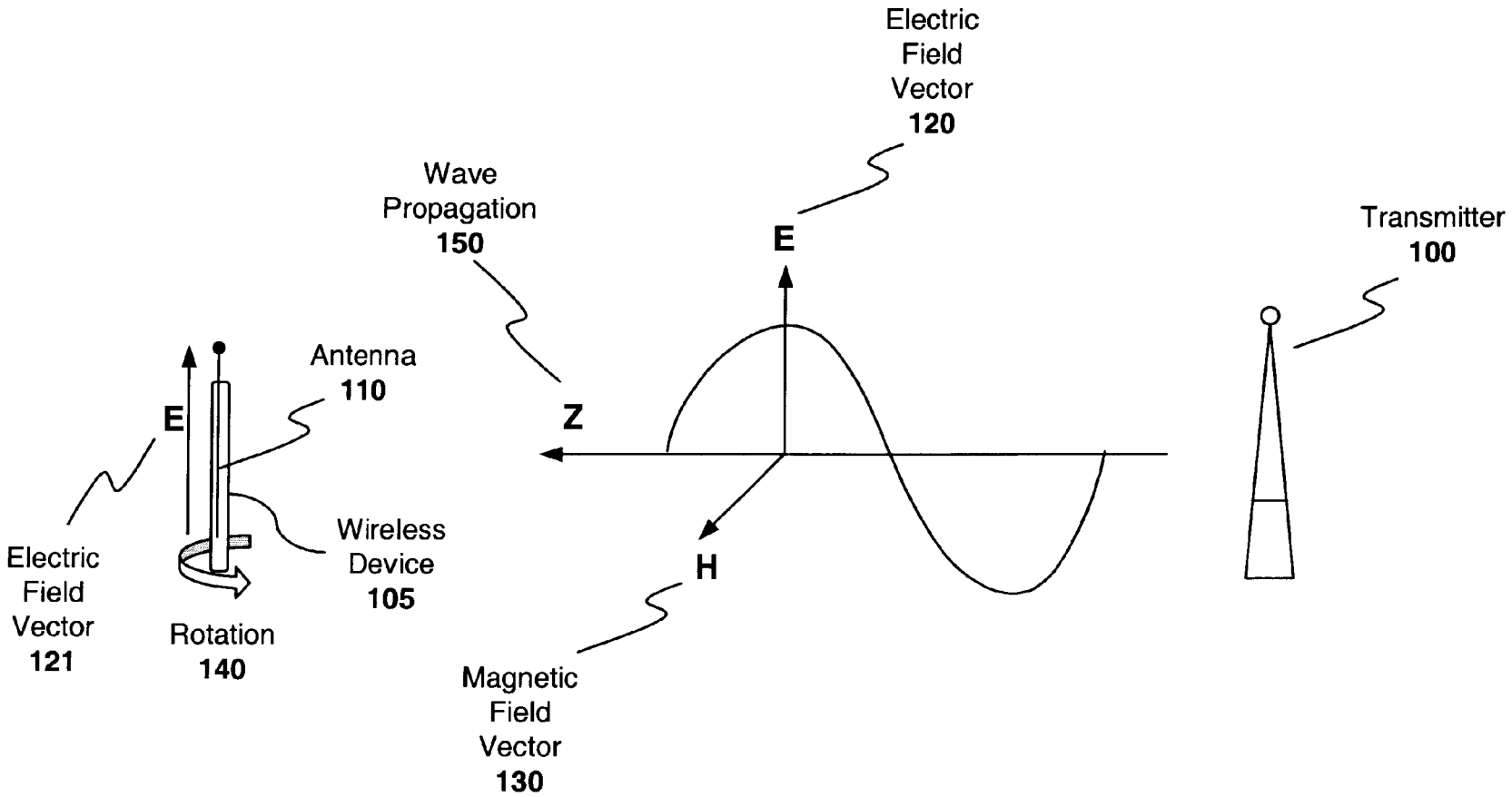
Fig. 1a (prior art)
FIG. 1*a* illustrates the relationship between a standard antenna and an electromagnetic wave.
Figure 1B:
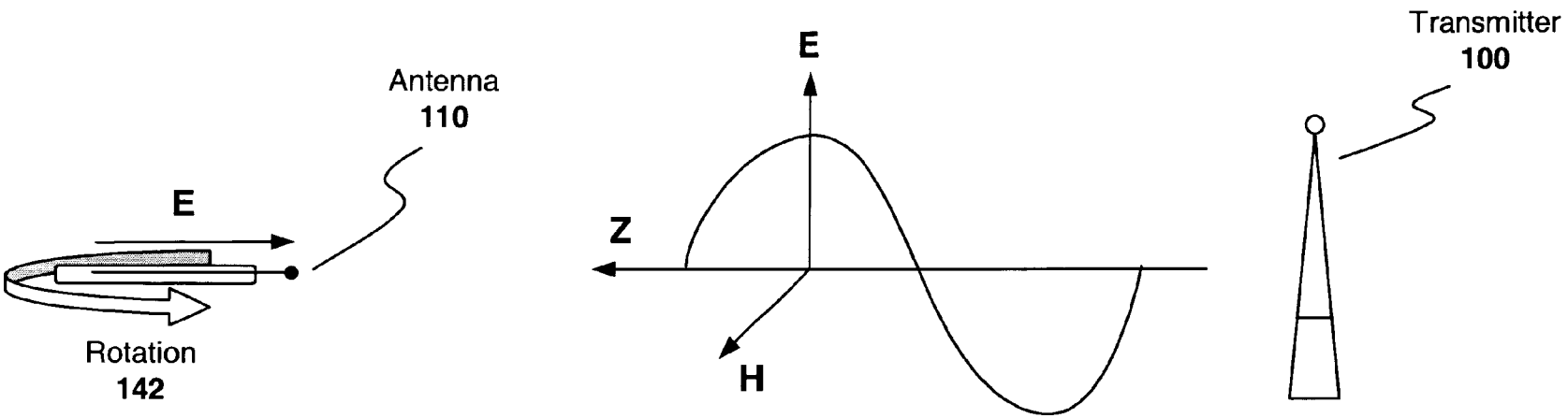
Fig. 1b (prior art)
FIG. 1*b* illustrates a standard antenna in which the antenna's electric field is perpendicular to the electric field of the base station's electromagnetic wave.
Figure 2A:
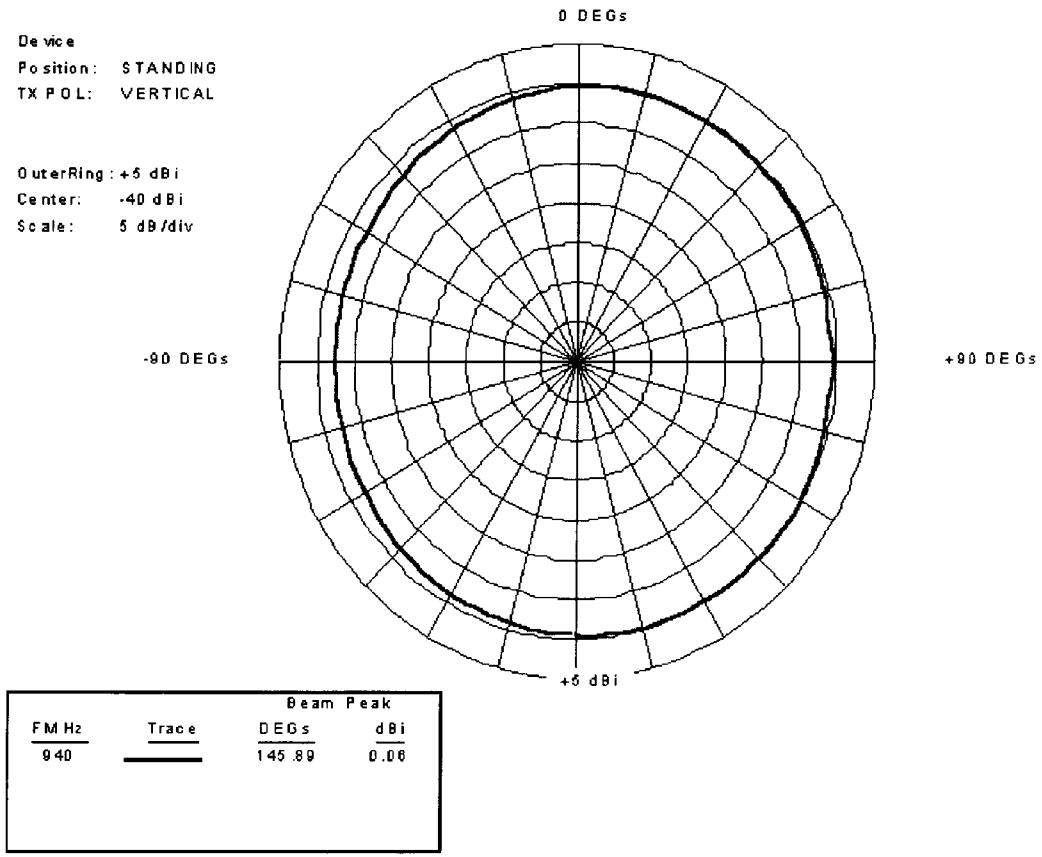
Fig. 2a (prior art)
FIG. 2*a* illustrates signal strength as a function of a first type of rotation of a standard antenna.
Figure 2B:
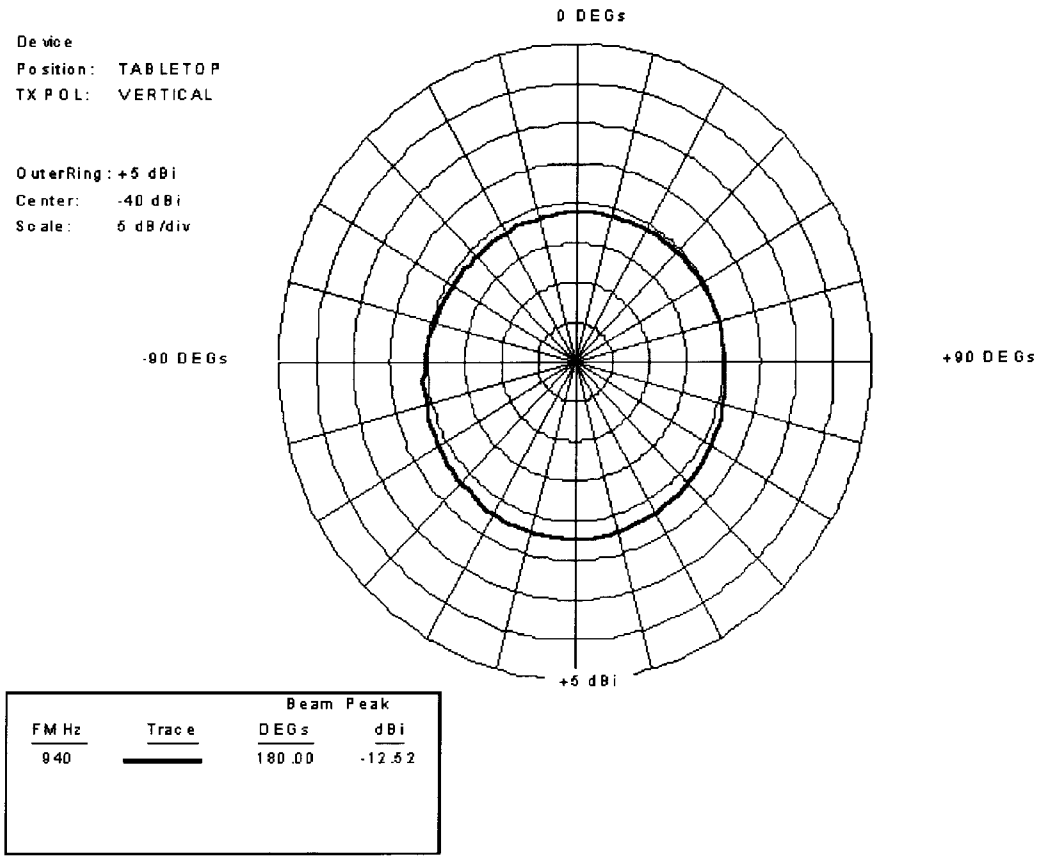
Fig. 2b (prior art)
FIG. 2*b* illustrates signal strength as a function of a second type of rotation of a standard antenna.
Figure 3:
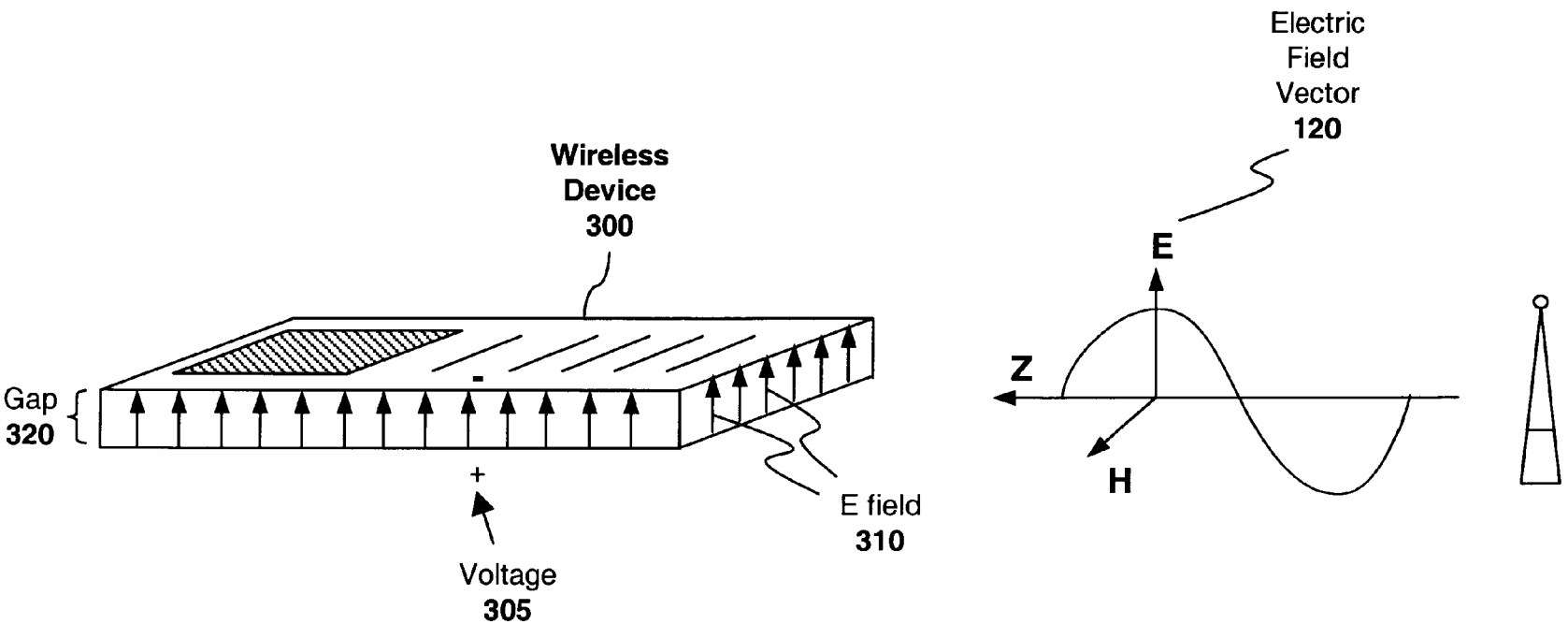
FIG. 3 illustrates an embodiment of the invention in which two plates generate a first electric field for receiving an electromagnetic signal.

As illustrated in FIG. 3, in one embodiment, a voltage 305 is applied between the top and the bottom plates of the case, thereby generating an electric field 310 between the plates. Because the electric field 310 has a vertical orientation when the device is in a horizontal position, it is capable of receiving vertically polarized waves. In other words, in this position, the signal's electric field vector 120 has the same (or similar) orientation as the case's electric field vector 310.

Figure 6B:
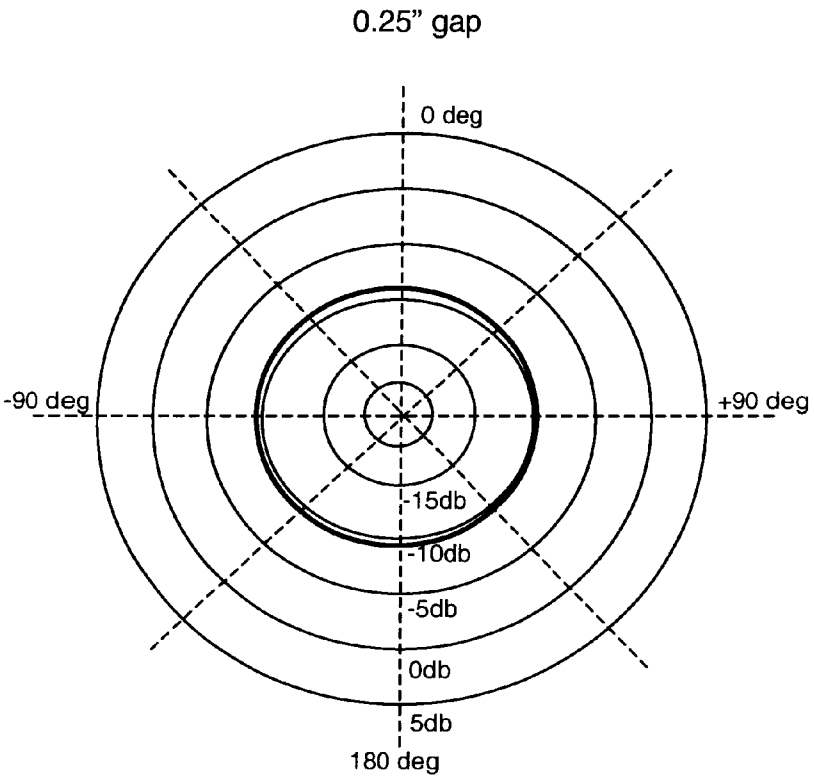
FIGS. 6*a–c* illustrate signal strength as a function of rotation for one embodiment of the invention.
Figure 6A:
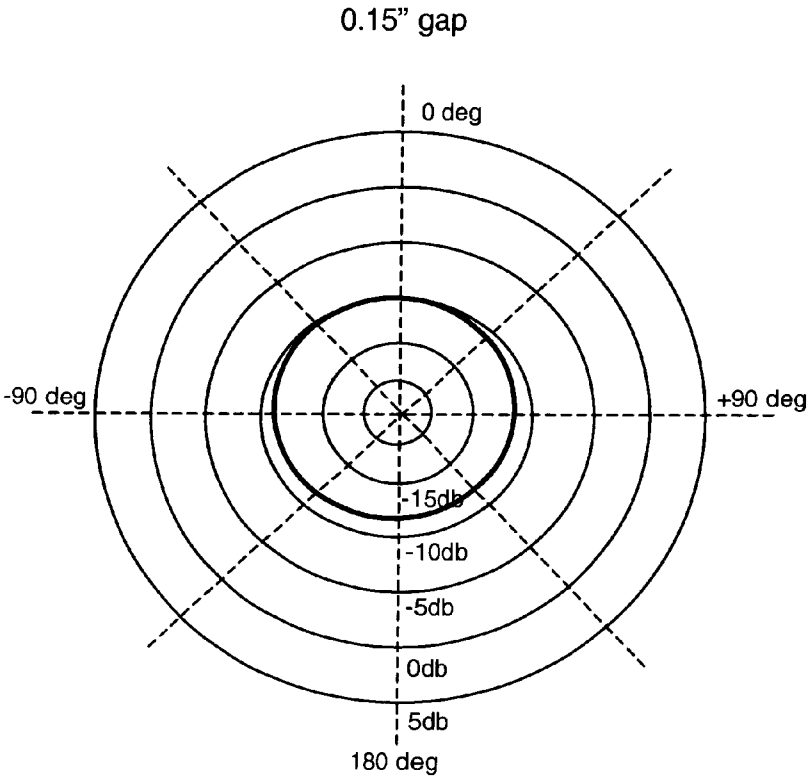
Figure 6C:
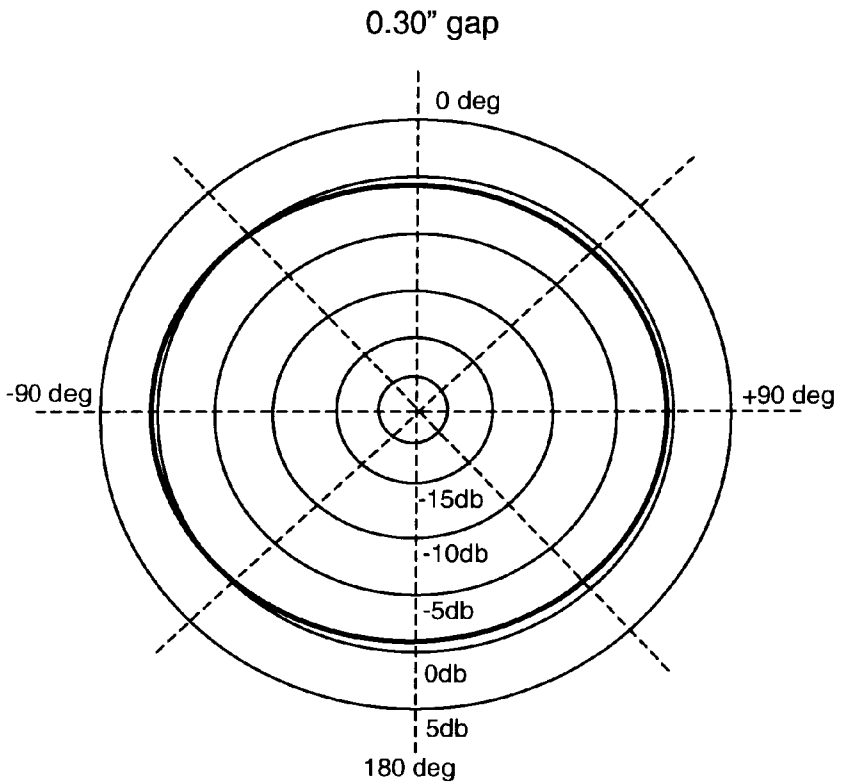

In one embodiment, the strength of the electric field and, consequently, the ability of the device to effectively receive vertically polarized waves, is proportional to the size of the gap 320 between the plates (all other variables being equal). FIGS. 6*a* through 6*c* illustrate this phenomenon using three different gap sizes for receiving a wave having a frequency of 940 MHz. The received signal strength is plotted as a device laying in a horizontal orientation (e.g., as shown in FIG. 3) is rotated around its vertical axis. As such, the electric field 310 generated by the charged plates is continually vertical. In FIG. 6*a*, the gap is set at 0.15" resulting in a maximum signal strength of −8.31 dBi and in FIG. 6*b*, the gap is set at 0.25" resulting in a maximum signal strength of −6.27 dbi. When the gap is raised to 0.30", however, the signal strength increases dramatically—up to a maximum of +1.10 dbi—indicating a critical minimum gap function for efficiently receiving the vertically polarized signal.

Figure 4:
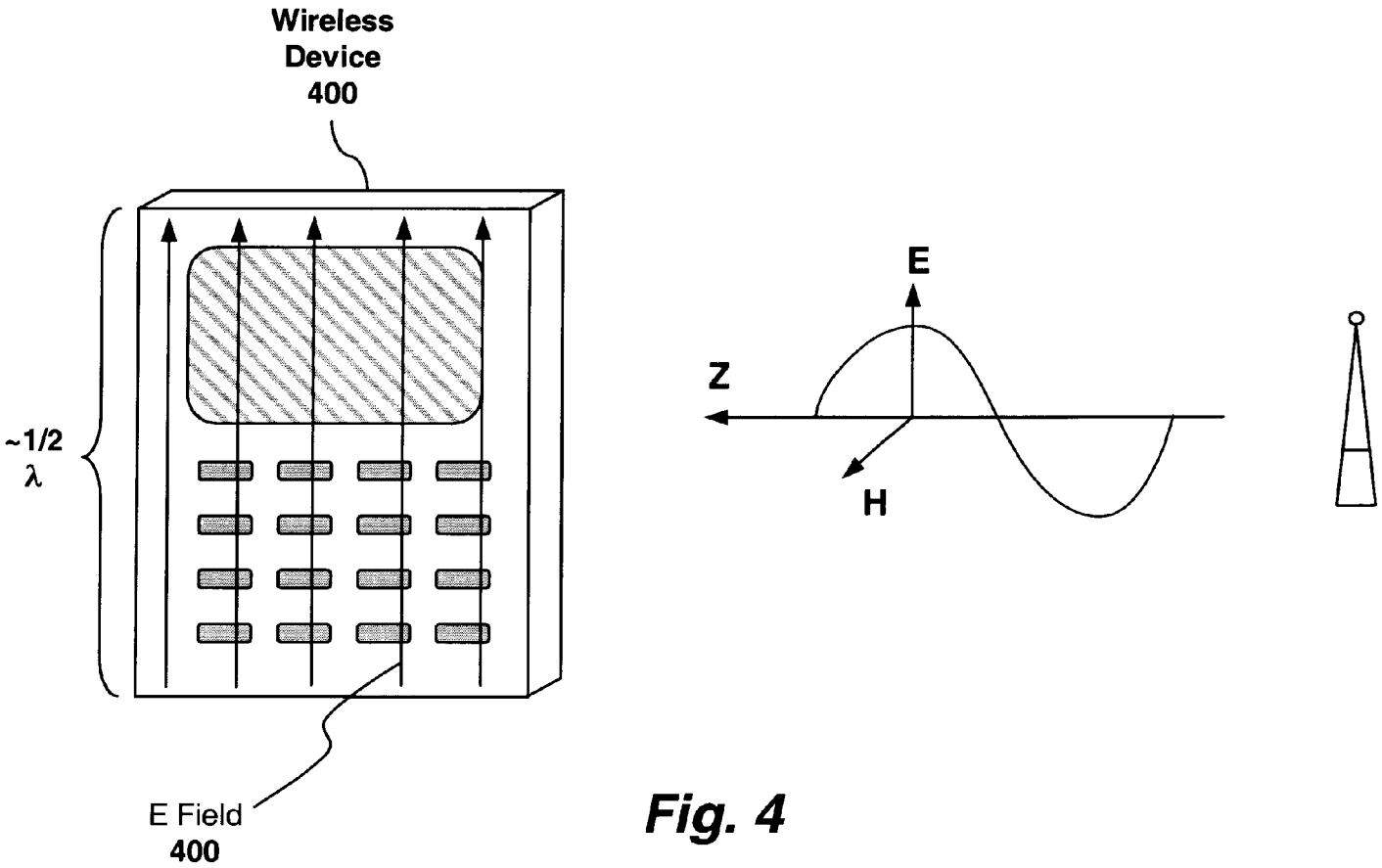
FIG. 4 illustrates an embodiment of the invention in which two plates generate a second electric field for receiving an electromagnetic signal.

It should be noted, however, that the underlying principles of the invention are not limited to any particular gap size. The most "appropriate" gap size may be based on variables including, but not limited to, the size of the top and bottom plates of the wireless device, the magnitude of the voltage applied between the plates, the size limitations of the wireless device and/or the characteristics of the electromagnetic signals received by the system (e.g., the signals' frequency/wavelength). Although the electric field 310 in FIG. 3 is suitable for receiving vertically polarized waves when the wireless device 300 has a horizontal orientation, this is not necessarily the case when the device is oriented vertically (i.e., because the vertical component of the electric field 310 may then be negligible). As such, in order to receive vertically polarized waves when the device is vertically oriented, one embodiment of the invention takes advantage of another antenna property of the case of the wireless device 300. Specifically, as illustrated in FIG. 4, if the sides of one of the plates (e.g., the front plate) is configured to be approximately ½ of a wavelength (□) of the received wave, then an electric field vector having a vertical electrical field component 400 will result. As such, the device will be capable of receiving vertically polarized waves in both a horizontal and vertical direction. In one embodiment, the back plate is made proportionally larger than the front plate.

In some circumstances ½ of a wavelength may not be an appropriate size for the wireless device 300 based on design requirements. For example, for a 950 MHz wave, □ is approximately equal to 32 centimeters and the height of the front plate would need to be in the range of 16 centimeters (~6.3 inches). This may be suitable for certain applications. However, if a smaller device is required based on design specifications, additional techniques may be employed to decrease the size of the device while still providing adequate signal reception in a vertical orientation.

Figure 5B:
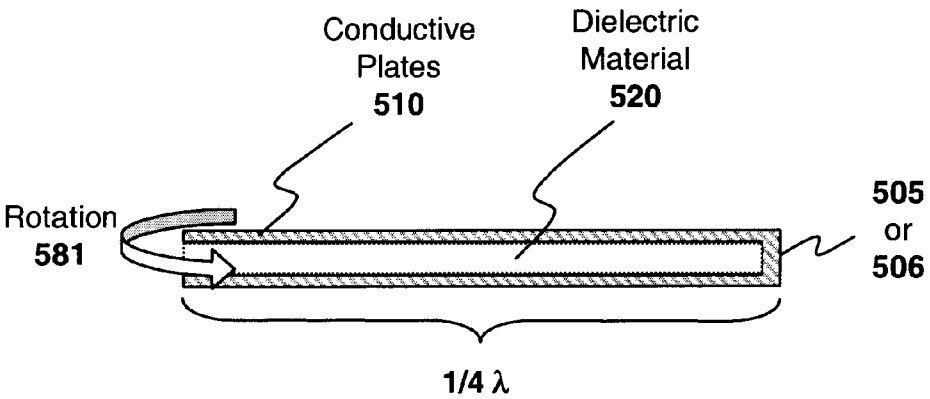
FIGS. 5*a–d* illustrate an embodiment of the invention in which the two plates are electrically coupled at one end.
Figure 5A:
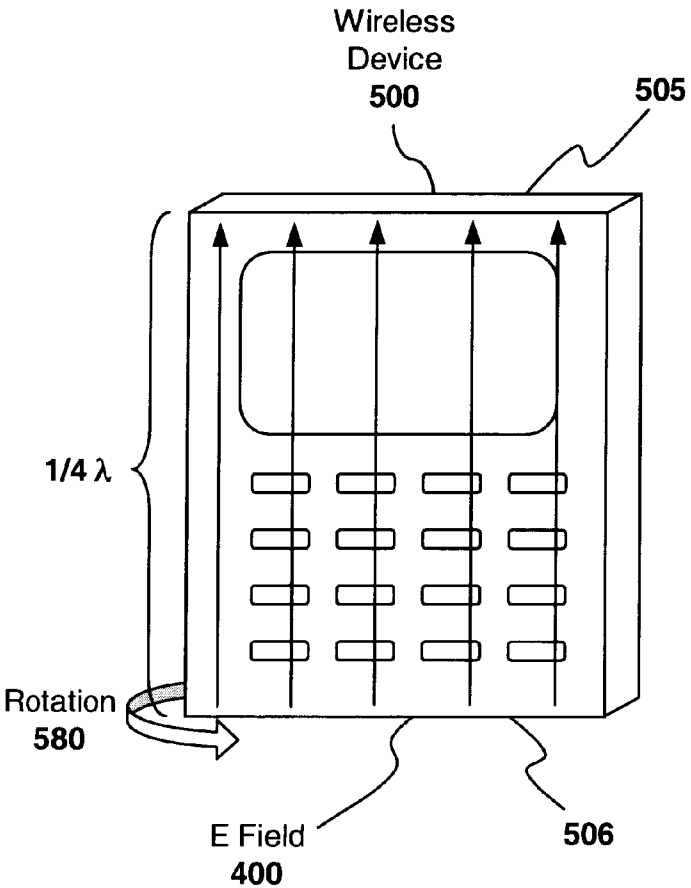

Specifically, FIGS. 5*a* illustrates an embodiment in which the height of the front plate is approximately ¼ of a wavelength. This embodiment of the wireless device 300 is capable of receiving waves in a vertical orientation using a ¼ □ plate because the front and back plates are coupled together. Specifically, as illustrated in FIG. 5*b*, which illustrates a side view of the device, the two conductive plates 510, separated by a dielectric material 520 are electrically coupled at the top 505 or bottom 506 of the device 500. Of course, the two "electrically coupled" plates may be a single plate bent at one or more angles to produce a geometrical relationship similar to that illustrated in FIG. 5*b*. The underlying principles of the invention remain the same regardless of how the plates are mechanically/electrically coupled together.

Figure 5C:
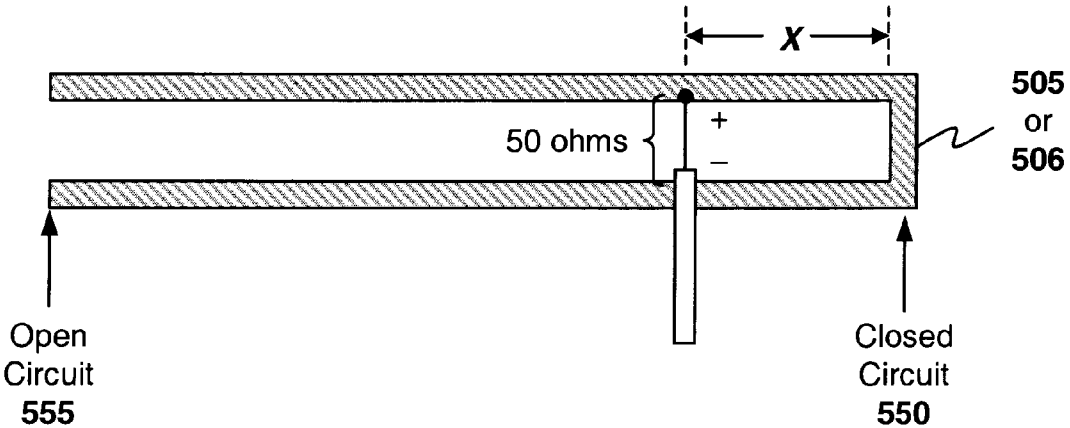
Figure 5D:
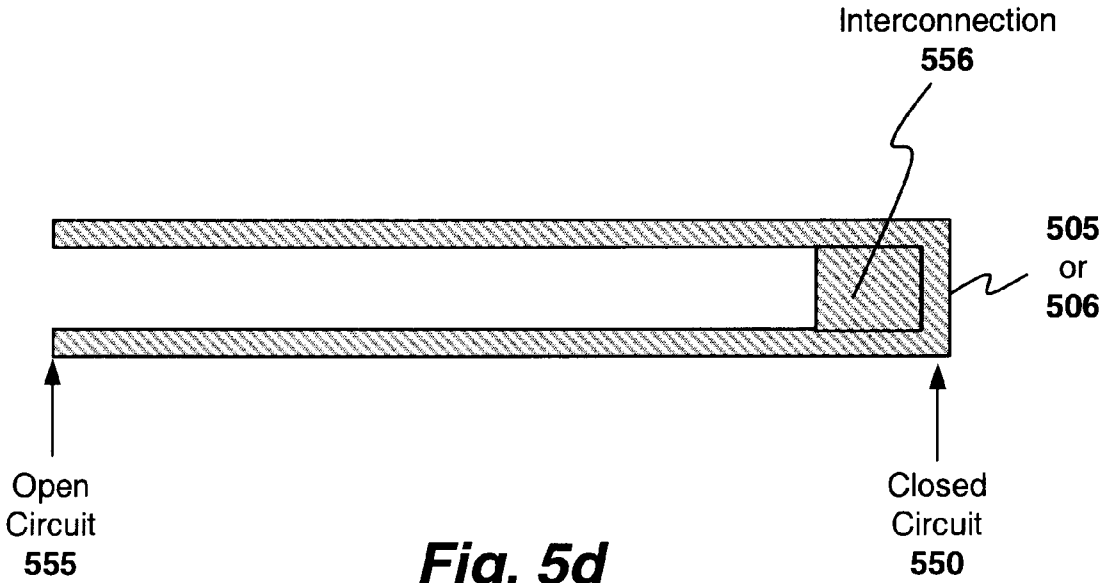

As illustrated in FIG. 5*d*, in one embodiment, the top and bottom plates may not merely be interconnected at their ends but may also be interconnected along their respective sides for some length (i.e., as indicated by interconnection 556). By varying this length, the resonant frequency of the antenna can be tuned to the desired frequency of the wireless device, regardless if the device is larger than a quarterwave at the design frequency.

Figure 7:
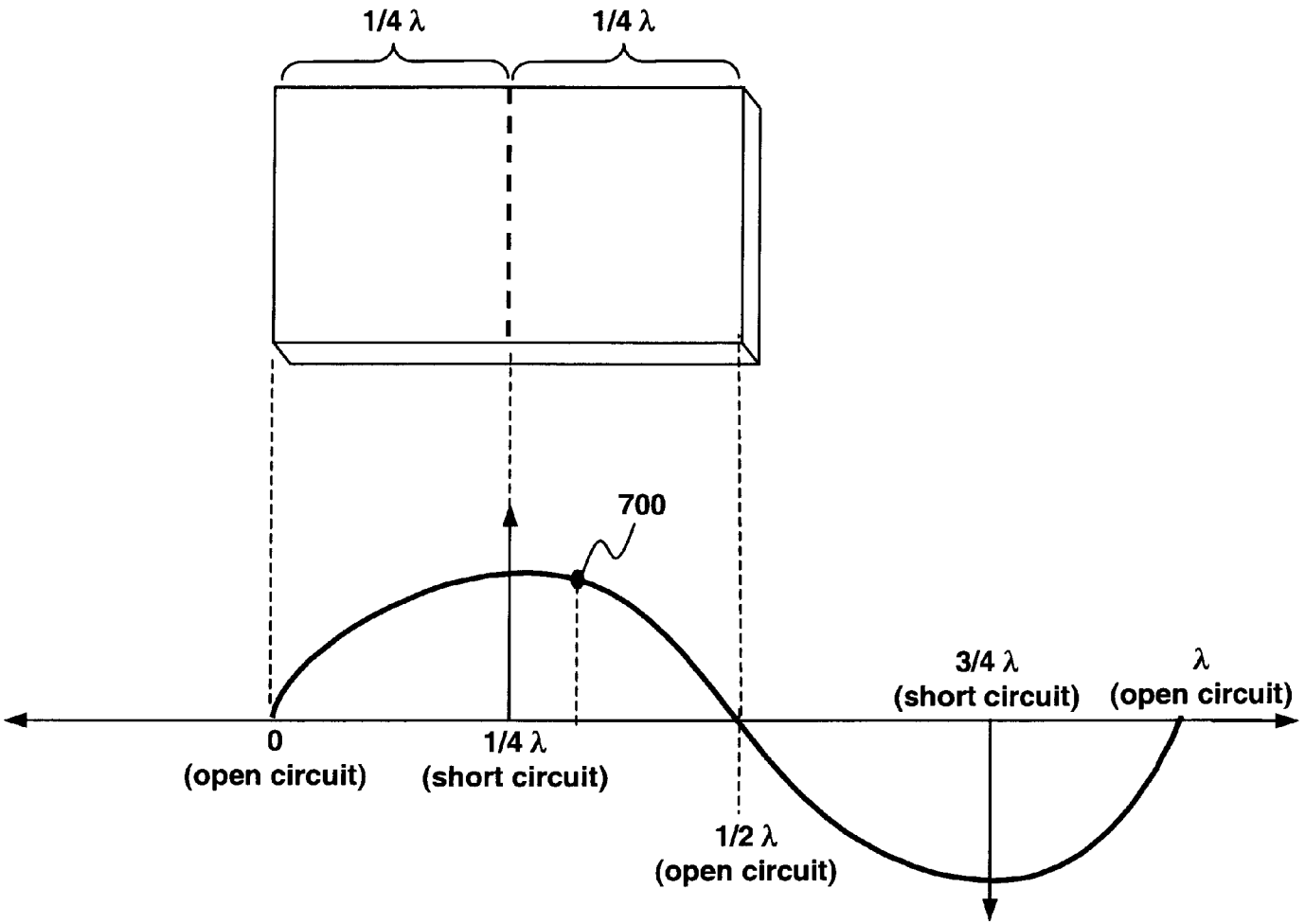
FIG. 7 illustrates the physical relationships between the electric plates and a wave according to one embodiment of the invention.

Coupling the plates as described above creates an antenna because of the manner in which the received signal maps to portions of the plates. This phenomenon will be described with respect to FIG. 7 which illustrates plates having a wavelength of ½ □. As illustrated, it may be assumed that one end of the plates is equivalent to an open circuit corresponding to the beginning of the wave (i.e., where the RF current amplitude of the wave=0), then moving along the plates from 0 to ¼ □ results in a shorted closed circuit (i.e., where the RF current amplitude of the wave has its maximum value). Based on this relationship, is may be assumed that a plate having a length of ½ □ may be folded back on itself resulting in two ¼ □ plates electrically coupled at one end as shown in FIG. 5*b*. In addition, as illustrated in FIG. 5*c*, the location of the signal feedline between the closed circuit 550 and the open circuit 555, will have an affect on signal reception. Specifically, if the wireless device 300 needs to operate at a particular impedance, that impedance may be located by moving a distance X from the closed circuit 550. As illustrated, in one embodiment, the desired impedance is 50 ohms. However, it should be noted that the required impedance is not relevant to the underlying principles of the invention. As indicated in FIG. 7, the particular impedance will correspond to a particular point 700 on the structure. Where the plates are shorted together, the impedance is electrically 0 ohms. Where the plates are open circuited, the impedance approaches infinite ohms. Between these two extremes, an impedance of 50 ohms, or 100 ohms, etc, is located.

Figure 8A:
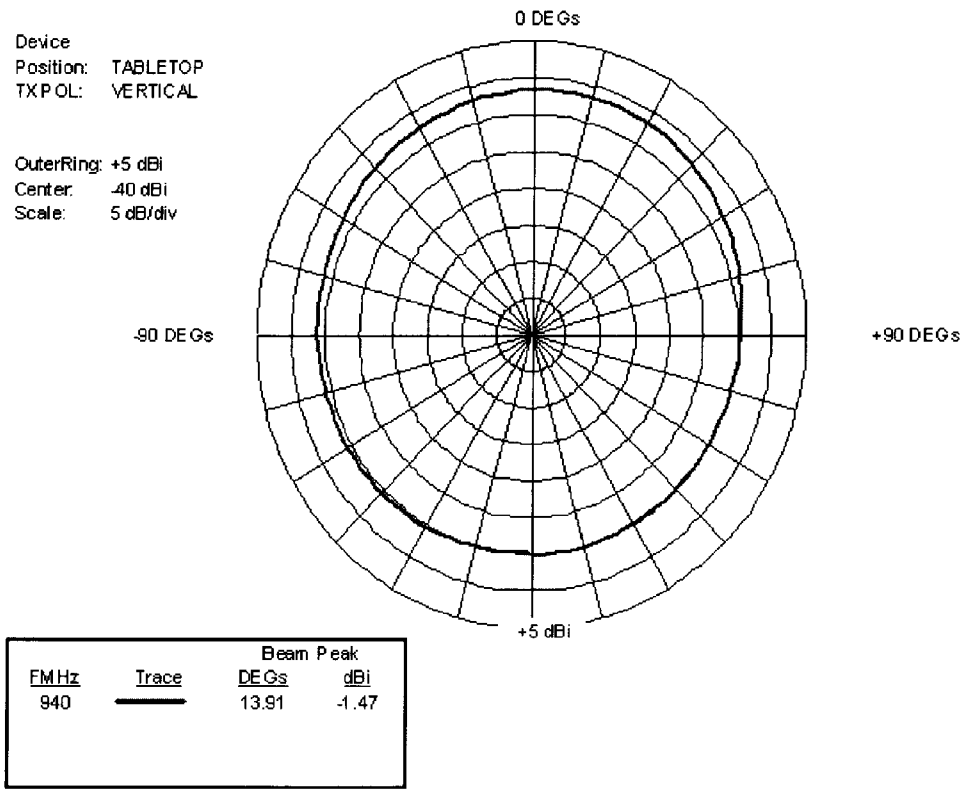
FIGS. 8*a–c* illustrate plots of signal strength as a function of rotation for three embodiment of the invention.
Figure 8B:
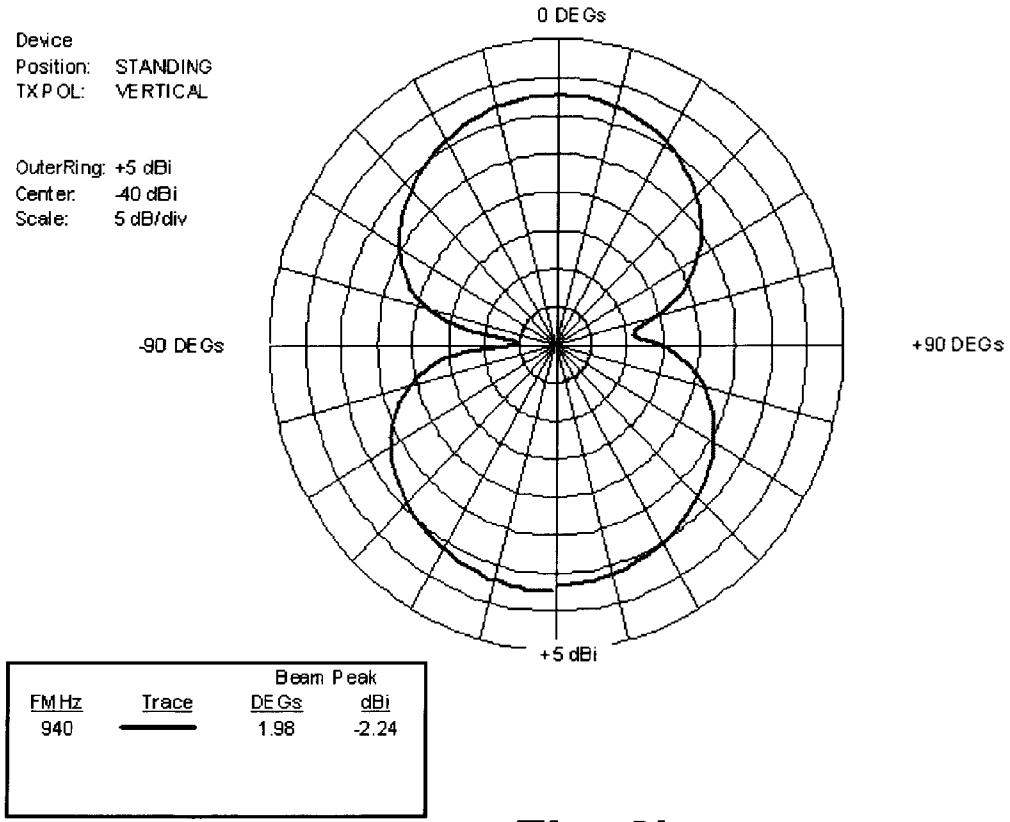

The signal strength plots illustrated in FIGS. 8*a* and 8*b* correspond to the embodiment of the invention illustrated in FIGS. 5*a* and 5*b*. Specifically, FIG. 8*a* illustrates signal strength as the wireless device 500 is rotated in a horizontal orientation, as indicated by rotation arrow 581 in FIG. 5*b*. FIG. 8*b* illustrates signal strength as the wireless device 500 is rotated in a vertical orientation, as indicated by rotation arrow 581 in FIG. 5*a*. As illustrated, the signal strength may not be entirely constant but remains reasonably high over the majority of the 360 degrees of the device's 500's rotation.

Figure 8C:
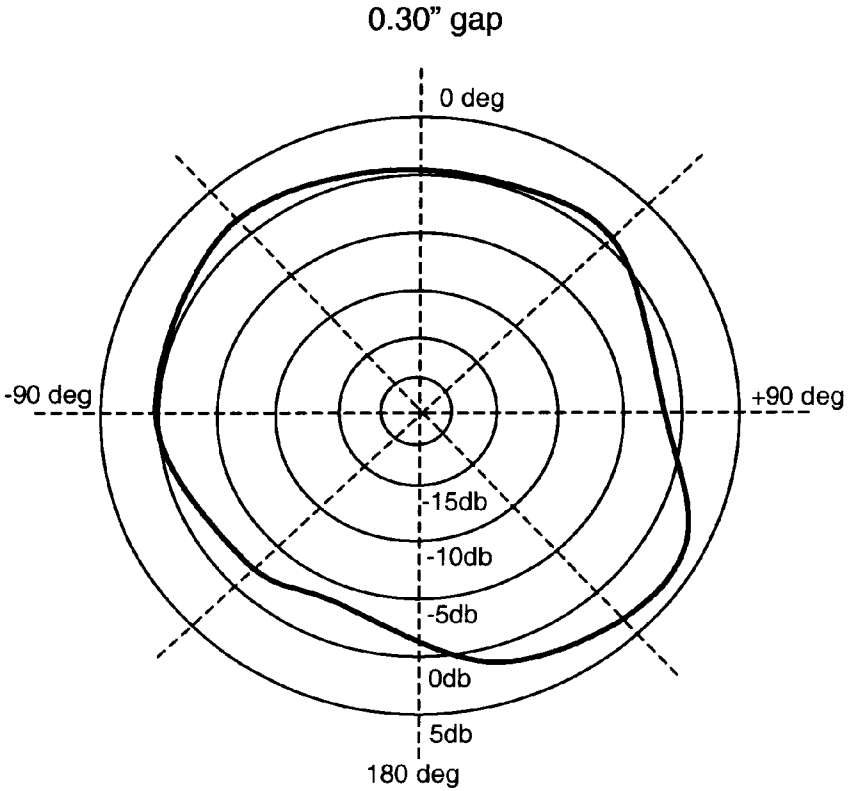

FIG. 8*c* illustrates a plot of signal strength as the embodiment of the wireless device 500 illustrated in FIG. 5*d* is rotated in a vertical orientation as indicated by rotation arrow 580 in FIG. 5*a*. In this embodiment, the signal strength remains reasonably high over the entire 360 degrees of the device's 500's rotation.

Throughout the foregoing description, for the purposes of explanation, numerous specific details were set forth in order to provide a thorough understanding of the invention. It will be apparent, however, to one skilled in the art that the invention may be practiced without some of these specific details. Accordingly, the scope and spirit of the invention should be judged in terms of the claims which follow.

What is claimed is:

1. An antenna for a wireless device comprising:

first and second plates separated by a specified distance and charged at a specific voltage relative to each other to generate a first electric field to receive an electromagnetic signal when said wireless device is in a first geometric orientation, wherein said plates are further configured with dimensions to generate a second electric field to receive said electromagnetic signal when said wireless device is in a second geometric orientation.

2. The antenna as in claim 1 wherein said dimensions comprise a side of one of said plates being approximately equal to ½ of a wavelength of said electromagnetic signal.

3. The antenna as in claim 1 wherein said dimensions comprise a side of one of said plates being approximately equal to ¼ of a wavelength of said electromagnetic signal.

4. The antenna as in claim 3 wherein said plates are electrically coupled at a first end and separated at a second end.

5. The antenna as in claim 4 further comprising:

a first conductive element and a second conductive element to communicatively couple said received signal to one or more functional components of said wireless device, said first conductive element coupled to said first plate and said second conductive element coupled to said second plate.

6. The antenna as in claim 5 wherein said first and second conductive elements are coupled to said first and second plates, respectively, at a specified distance from said first end, said specified distance selected based on a desired impedance.

7. The antenna as in claim 1 wherein said first electric field is substantially perpendicular to said second electric field.

8. The antenna as in claim 1 wherein said first geometric orientation is a horizontal orientation and said second geometric orientation is a vertical orientation.

9. The antenna as in claim 1 wherein said first and second plates comprise an enclosure or a portion thereof for functional components of said wireless device.

10. The antenna as in claim 1 further comprising:

a first conductive element and a second conductive element to communicatively couple said received signal to one or more functional components of said wireless device, said first conductive element coupled to said first plate and said second conductive element coupled to said second plate.

11. An apparatus comprising:

an enclosure for a wireless device to receive electromagnetic waves in both a horizontal and a vertical orientation, the enclosure having:

first and second conductive plates separated by a dielectric to generate a first electric field for receiving said electromagnetic waves in said horizontal orientation, and sized to generate a second electric field for receiving said electromagnetic waves in said vertical orientation.

12. The apparatus as in claim 11 wherein a length of a side of one of said plates is approximately equal to ½ of a wavelength of said electromagnetic waves.

13. The apparatus as in clime 11 wherein a length of a side of one of said plates is approximately equal to ¼ of a wavelength of said electromagnetic waves.

14. The apparatus as in claim 13 wherein said first and second conductive plates are electrically coupled at one extreme and separated at a second extreme.

15. The apparatus as in claim 14 further comprising:

a first conductive element and a second conductive element to communicatively couple said received electromagnetic wave to one or more functional components of said wireless device, said first conductive element coupled to said first conductive plate and said second conductive element coupled to said second conductive plate.

16. The antenna as in claim 15 wherein said first and second conductive elements are coupled to said first and second plates, respectively, at a predetermined distance from said first end.

17. The apparatus as in claim 11 wherein said first electric field is substantially perpendicular to said second electric field.

18. The apparatus as in claim 11 further comprising:

a first conductive element and a second conductive element to communicatively couple said received electromagnetic wave to one or more functional components of said wireless device, said first conductive element coupled to said first conductive plate and said second conductive element coupled to said second conductive plate.

19. A method for creating an antenna for a wireless data processing device comprising:

separating first and second plates of the wireless device by a specified distance;

generating a first electric field to receive an electromagnetic signal when the wireless device is in a first geometric orientation by charging the first and second plates at a specific voltage relative to each other; and generating a second electric field to receive the electromagnetic signal when the wireless device is in a second geometric orientation.

20. The method as in claim 19 wherein said dimensions comprise a side of one of said plates being approximately equal to ½ of a wavelength of said electromagnetic signal.

21. The method as in claim 19 wherein said dimensions comprise a side of one of said plates being approximately equal to ¼ of a wavelength of said electromagnetic signal.

22. The method as in claim 21 wherein said plates are electrically coupled at a first end and separated at a second end.

23. The method as in claim 19 wherein said first electric field is substantially perpendicular to said second electric field.

24. The method as in claim 19 wherein said first geometric orientation is a horizontal orientation and said second geometric orientation is a vertical orientation.

25. The method as in claim 19 wherein said first and second plates comprise an enclosure or a portion thereof for functional components of said wireless device.

26. The method as in claim 19 further comprising:

communicatively coupling said received signal to one or more functional components of said wireless device via a first conductive element and a second conductive element, said first conductive element coupled to said first plate and said second conductive element coupled to said second plate.

27. The method as in claim 26 further comprising:

communicatively coupling said received signal to one or more functional components of said wireless device via a first conductive element and a second conductive element, said first conductive element coupled to said first plate and said second conductive element coupled to said second plate.

28. The method as in claim 27 wherein said first and second conductive elements are coupled to said first and second plates, respectively, at a specified distance from said first end, said specified distance based on a desired impedance.

* * * * *